US008757978B2

(12) United States Patent
Takeshita

(10) Patent No.: US 8,757,978 B2
(45) Date of Patent: Jun. 24, 2014

(54) BLOWER IMPELLER AND BLOWER

(75) Inventor: Hidenobu Takeshita, Kyoto (JP)

(73) Assignee: Nidec Corporation, Kyoto (JP)

( * ) Notice: Subject to any disclaimer, the term of this patent is extended or adjusted under 35 U.S.C. 154(b) by 1158 days.

(21) Appl. No.: 12/710,488

(22) Filed: Feb. 23, 2010

(65) Prior Publication Data

US 2010/0215505 A1 Aug. 26, 2010

(30) Foreign Application Priority Data

Feb. 24, 2009 (JP) ..... 2009-040412

(51) Int. Cl.
*F01D 5/10* (2006.01)
*F01D 25/04* (2006.01)

(52) U.S. Cl.
USPC ..... 416/185

(58) Field of Classification Search
USPC ..... 361/695; 416/182, 185, 244 R
See application file for complete search history.

(56) References Cited

U.S. PATENT DOCUMENTS 5,193,981 A * 3/1993 Scheidel et al. ..... 416/179
5,574,321 A * 11/1996 Baker ..... 310/67 R
5,610,462 A * 3/1997 Takahashi ..... 310/90
7,045,919 B1 * 5/2006 Lin ..... 310/67 R
7,364,400 B2 * 4/2008 Ku et al. ..... 415/111
7,442,010 B2 * 10/2008 Gruber et al. ..... 416/169 A
2003/0086787 A1 5/2003 Kondo et al.
2006/0233643 A1 10/2006 Lin et al.
2008/0063542 A1 3/2008 Oguma
2008/0219845 A1 * 9/2008 Chen et al. ..... 416/95
2008/0260517 A1 * 10/2008 Hayashigaito et al. ..... 415/68
2009/0035149 A1 * 2/2009 Sun et al. ..... 416/244 R

FOREIGN PATENT DOCUMENTS

CN 2649824 Y 10/2004
JP 2003-139092 A 5/2003

* cited by examiner

*Primary Examiner* — Nathaniel Wiehe
*Assistant Examiner* — Sean J Younger
(74) *Attorney, Agent, or Firm* — Keating & Bennett, LLP

(57) ABSTRACT

A blower impeller includes a substantially cylindrical cup portion, and a plurality of blades arranged on an outer circumferential surface of a circumferential wall portion of the cup portion. The cup portion includes on an inner circumferential surface of the circumferential wall portion thereof a plurality of axially extending first ribs and a plurality of second ribs arranged between the first ribs. The first and second ribs are arranged in a circumferential direction. A virtual envelope joining radially inner end portions of the first ribs has a smaller diameter than that of a virtual envelope joining radially inner end portions of the second ribs.

19 Claims, 12 Drawing Sheets

BLOWER IMPELLER AND BLOWER

BACKGROUND OF THE INVENTION

1. Field of the Invention

The present invention relates to the structure of an impeller. More specifically, the present invention relates to an impeller for use in a blower.

2. Description of the Related Art

In conventional blowers (blower fans), a motor is arranged inside a cylindrical impeller cup to rotate an impeller with a plurality of blades. The motor includes a stator portion and a rotor portion supported so as to be rotatable with respect to the stator portion. A cylindrical rotor holder is press-fitted to an inner circumferential surface of the impeller cup, so that the impeller is fixed to the rotor holder.

When the rotor holder is press-fitted to the entire inner circumferential surface of the impeller cup, a significantly uneven shape of the rotor holder or the impeller cup leads to an excessive pressure being applied to a portion of the impeller cup, which will result in a breakage of the impeller cup.

JP-A 2008-69672 describes a technique used to overcome the above problem. According to the technique described in JP-A 2008-69672, a plurality of axially extending ribs are arranged in a circumferential direction on the inner circumferential surface of the impeller cup, and the rotor holder is press-fitted to an inside of the impeller cup while also being pressed against a top portion of each rib, so that the impeller is fixed to the rotor holder. According to this technique, when the rotor holder is press-fitted to the impeller cup, the aforementioned excessive pressure due to the uneven shape of the rotor holder or the impeller cup would be absorbed by elastic deformation of the ribs to prevent the breakage of the impeller cup.

The number of blades of the impeller is determined based on the purpose or intended use of the blower or the like. For purposes of cooling an electronic device, such as a server, which is densely packed with components, for example, the blower is required to be capable of providing high static pressure. For the purposes of providing high static pressure, blowers (cooling fans) having an impeller with a small number (e.g., three to five) of blades are suitable. Thus, fans having an impeller with a small number of blades are frequently used in accordance with such demand.

FIGS. 1A, 1B, and 1C are perspective views each illustrating the structure of an impeller with a plurality of blades 102 attached to an outer circumferential surface of an impeller cup 101. In FIG. 1A, the impeller has seven blades 102. In FIG. 1B, the impeller has five blades 102. In FIG. 1C, the impeller has three blades 102. As is apparent from FIGS. 1A to 1C, as the number of blades 102 decreases, the inclination of each blade 102 with respect to an axis of the impeller cup 101 becomes greater, and the length of a root portion 102*a* of each blade 102 at which the blade 102 comes in contact with the outer circumferential surface of the impeller cup 101 becomes greater.

In general, the impeller cup 101 and the blades 102 are integrally molded in one piece of a resin or the like. In this case, a stress is applied to an outer wall portion of the impeller cup 101 at the root portion 102*a* of each blade 102, at which the blade 102 comes in contact with the outer circumferential surface of the impeller cup 101. These stresses have certain distributions in circumferential and axial directions with respect to the outer wall portion of the impeller cup 101 depending on the arrangement of the root portions 102*a* of the blades 102. In the case where the number of blades 102 is large, the stress distributions are substantially even, whereas in the case where the number of blades 102 is small, the stress distributions are uneven. Therefore, when the number of blades 102 is small, the impeller cup 101 tends to undergo a deformation easily. The deformation of the impeller cup 101 will result in reduced adhesion between the impeller cup 101 and the rotor holder, which may lead to the impeller coming off the rotor holder. Moreover, in the case where there is only a small gap between the blades 102 and a case of the blower, the blades 102 may come in touch with the case during rotation of the impeller.

Furthermore, as the number of blades 102 decreases, the weight of each blade increases, and therefore the stress applied to the outer wall portion of the impeller cup 101 becomes greater. Thus, in the case where the number of blades 102 is small, the rotating impeller may undergo a deformation due to the stress, so that the impeller may come off the rotor holder or that the impeller cup 101 may be broken due to the stress. This problem becomes evident when the impeller is caused to rotate at a high speed in order to increase the air flow quantity of the blower.

It is conceivable to increase the wall thickness of the impeller cup 101 in order to overcome the above problem. However, it is difficult to simply increase the wall thickness thereof because of a deformation accompanying contraction when the impeller is molded of the resin, a constraint in terms of the outer diameter of the impeller cup 101, and so on.

It is also conceivable to increase the number of ribs provided on an inner circumferential surface of the impeller cup 101 to enhance the adhesion between the impeller cup 101 and the rotor holder. However, an increase in the number of ribs results in increased resistance when the rotor holder is press-fitted to the impeller cup, which may also lead to the breakage of the impeller cup 101.

SUMMARY OF THE INVENTION

According to a preferred embodiment of the present invention, a blower impeller includes a substantially cylindrical cup portion, and a plurality of blades arranged on an outer circumferential surface of a circumferential wall portion of the cup portion. The cup portion includes a plurality of axially extending first ribs on an inner circumferential surface of the circumferential wall portion thereof and a plurality of second ribs arranged between the first ribs. The first and second ribs are preferably arranged in a circumferential direction such that a virtual envelope joining radially inner end portions of the first ribs has a smaller diameter than that of a virtual envelope joining radially inner end portions of the second ribs.

An impeller according to this preferred embodiment is excellent in retaining a rotor holder and has an improved strength, because the rotor holder arranged inside the cup portion can be retained by the first ribs, and the strength of the cup portion is reinforced by the second ribs. That is, the first ribs are arranged to perform a primary function of retaining the rotor holder while the second ribs are arranged to perform a primary function of reinforcing the strength of the cup portion.

The aforementioned effects are accomplished because the second ribs do not provide resistance when the rotor holder is press-fitted to an inside of the cup portion, and the second ribs arranged between the first ribs act to equalize uneven stresses applied to an outer wall portion of the cup portion. Thus, an improvement in the strength of the impeller is achieved while the impeller maintains the capacity of retaining the rotor holder, without increasing the wall thickness of the cup portion or increasing the number of first ribs to retain the rotor holder.

According to another preferred embodiment of the present invention, a blower impeller includes a substantially cylindrical cup portion, and a plurality of blades arranged on an outer circumferential surface of a circumferential wall portion of the cup portion. The cup portion includes on an inner circumferential surface of the circumferential wall portion thereof a plurality of axially extending first ribs and a plurality of second ribs arranged between the first ribs. The first and second ribs are preferably arranged in a circumferential direction such that the extent of radially inward projection of the first ribs is greater than the extent of radially inward projection of the second ribs.

According to a preferred embodiment of the present invention, the first ribs may preferably be arranged at regular intervals in the circumferential direction on the inner circumferential surface of the circumferential wall portion of the cup portion.

According to a preferred embodiment of the present invention, two or more of the second ribs may preferably be arranged between each pair of neighboring first ribs. Also, the second ribs may have a greater width than that of the first ribs. Also, the second ribs may have different axial lengths with respect to axial lengths of the first ribs.

According to a preferred embodiment of the present invention, lower end portions of the second ribs may preferably be arranged to perform a balance adjustment function which adjusts a displacement of a center of gravity of the impeller, while the second ribs may also be arranged to perform the function of reinforcing the strength of the cup portion.

According to a preferred embodiment of the present invention, a lower end portion of any of specific ones of the second ribs on which a balance adjustment has been performed may extend farther toward a lower end of the cup portion than the lower end portions of any of the other second ribs on which the balance adjustment has not been performed.

According to a preferred embodiment of the present invention, it may be so arranged that when the substantially cylindrical cup portion is divided into first and second semicylinders by an arbitrary imaginary plane including a central axis of the cup portion, a total volume of the second ribs arranged on an inner circumferential surface of a circumferential wall portion of the first semicylinder is different from a total volume of the second ribs arranged on an inner circumferential surface of a circumferential wall portion of the second semicylinder.

According to a preferred embodiment of the present invention, a balance adjustment may be performed on one or more of the second ribs such that when the inner circumferential surface of the cup portion is circumferentially divided into two equal sections, the two equal sections being a first section including the one or more balance-adjusted second ribs and a second section not including any balance-adjusted second rib, a total volume of the second ribs included in the first section is greater than a total volume of the second ribs included in the second section.

According to a preferred embodiment of the present invention, the impeller may be formed by injection molding, for example, and the lower end portion of any of the second ribs on which a balance adjustment has been performed is formed as a result of removing a corresponding portion of a mold.

Other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of the present invention will be described in detail with reference to the accompanying drawings. Note that the present invention is not limited to the preferred embodiments described below, and that variations and modifications can be made as appropriate as long as desired effects of the present invention are not impaired. Also note that the preferred embodiments may be combined with other preferred embodiments.

First, the structure of a blower using a blower impeller according to a preferred embodiment of the present invention will now be described below with reference to FIG. 2.

Figure 1A:
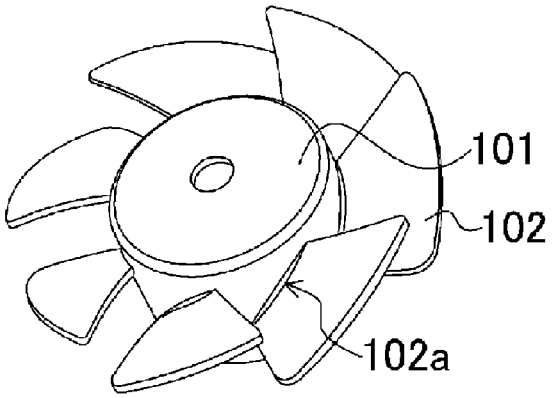
FIGS. 1A, 1B, and 1C are perspective views illustrating the structure of impellers with seven, five, and three blades, respectively.
Figure 1B:
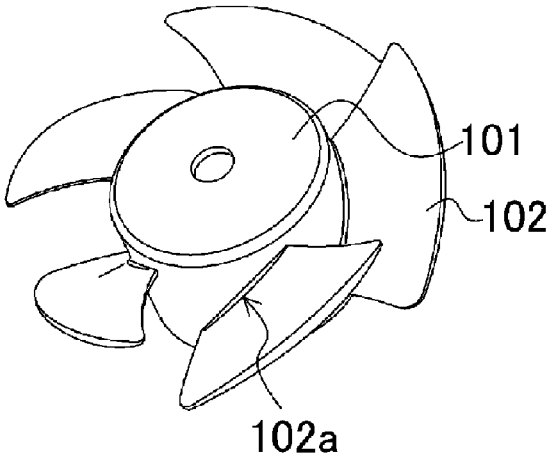
Figure 1C:
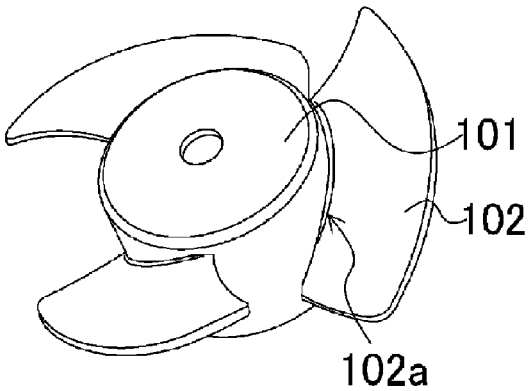
Figure 2:
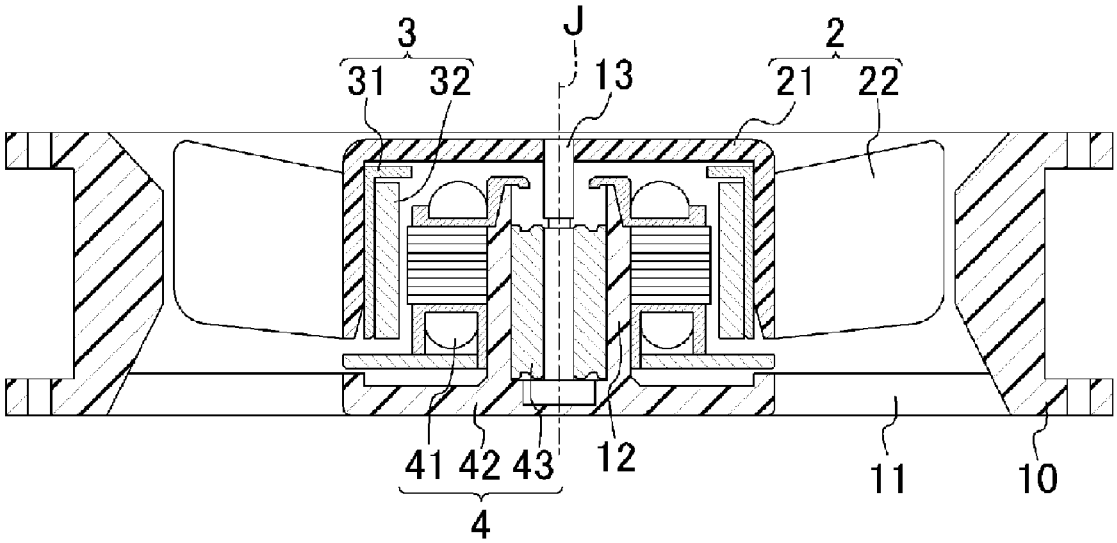
FIG. 2 is a cross-sectional view illustrating the structure of a blower according to a preferred embodiment of the present invention.

FIG. 2 is a cross-sectional view of the blower according to a preferred embodiment of the present invention taken along a plane including a central axis J. In FIG. 2, an impeller 2 including a cup portion 21 and a plurality of blades are contained in a housing 10. The cup portion 21 is substantially defined by the shape of a covered cylinder. The blades 22 are arranged on an outer circumferential surface of a circumferential wall portion of the cup portion 21. A rotor portion 3, which is fixed to the cup portion 21, and a stator portion 4, which is arranged to support the rotor portion 3 rotatably, are arranged inside the cup portion 21 of the impeller 2. In the following description, for the sake of convenience, a side that an opening of the cup portion 21 faces and a side that a cover of the cup portion 21 faces along the central axis J will be referred to as a lower side and an upper side, respectively.

The rotor portion 3 preferably includes a substantially cylindrical rotor holder 31 and a substantially cylindrical field magnet 32. The field magnet 32 is fixed to an inside of a side wall portion of the rotor holder 31. The stator portion 4 preferably includes a substantially disc-shaped base portion 42, an armature 41, and a sleeve 43. The armature 41 is preferably fixed to an outside of a bearing support portion 12 protruding upward from the base portion 42. The sleeve 43 is preferably fixed to an inside of the bearing support portion 12. The base portion 42 is preferably fixed to the housing 10 through a plurality of ribs 11.

A shaft 13 is preferably fixed at a central portion of the cover of the cup portion 21, and extends downward therefrom. The shaft 13 is inserted in the sleeve 43 of the stator portion 4, and rotatably supported by the sleeve 43. The sleeve 43 is preferably a porous member impregnated with lubricating oil, but any other desirable type of sleeve could be used.

In the blower structured as described above, a drive current is supplied to the armature 41 so that a torque centered on the central axis J is produced between the armature 41 and the field magnet 32. As a result, the blades 22 arranged on the outer circumferential surface of the circumferential wall portion of the cup portion 21 are caused to rotate about the central axis J together with the cup portion 21 fixed to the rotor holder 31 and the shaft 13 fixed to the cup portion 21. Here, the shaft 13 and the sleeve 43 constitute a bearing mechanism (a so-called oil-impregnated bearing) arranged to support the impeller 2 to be rotatable with respect to the stator portion 4.

Figure 3:
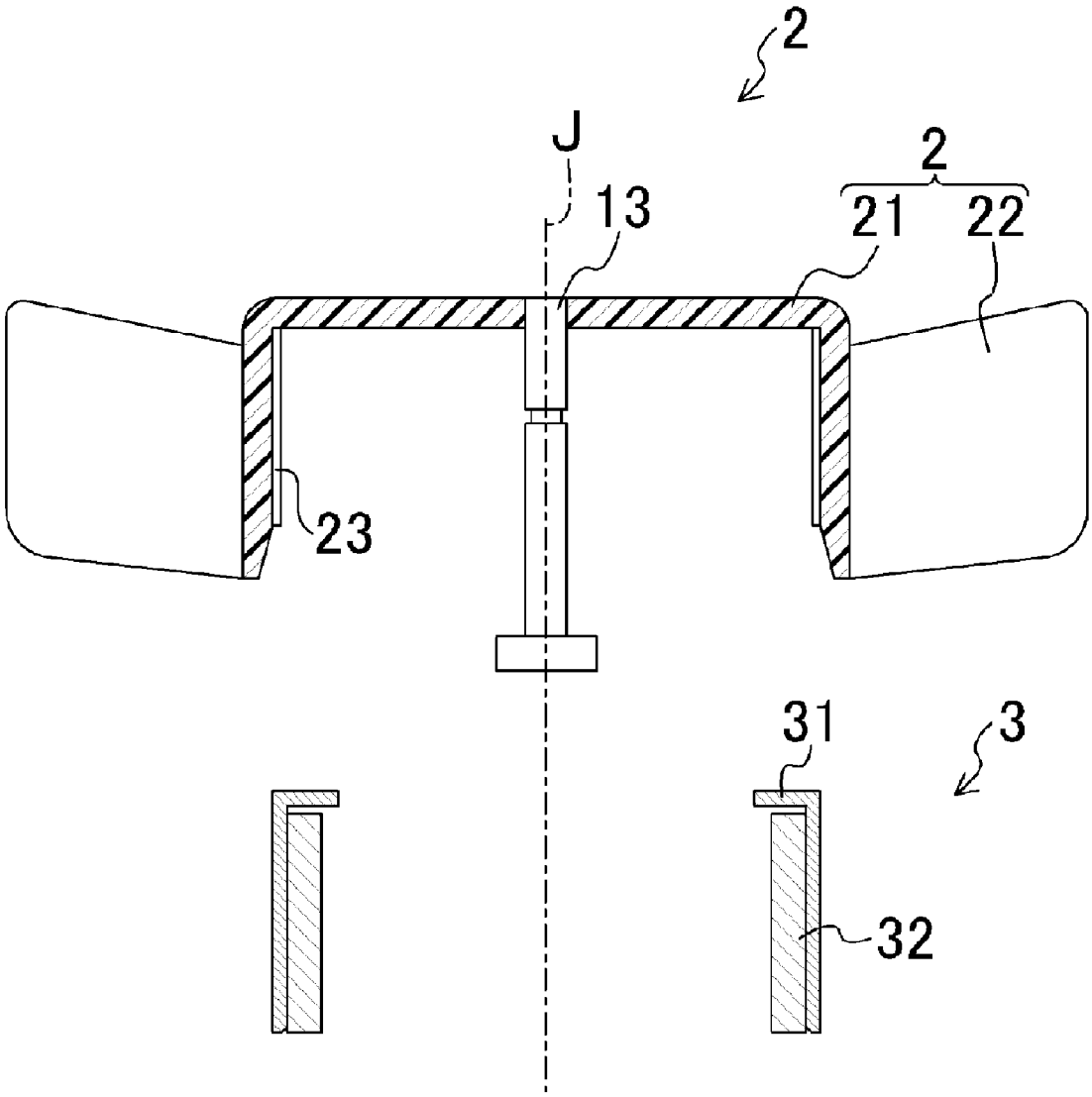
FIG. 3 is a cross-sectional view illustrating how a rotor portion is fixed to an impeller according to a preferred embodiment of the present invention.

The rotor portion 3 is preferably fixed to the impeller 2 in a manner as illustrated in FIG. 3. Specifically, a plurality of first ribs 23 extending along the central axis J are arranged in a circumferential direction on an inner circumferential surface of the circumferential wall portion of the cup portion 21 of the impeller 2. The rotor holder 31 of the rotor portion 3 is press-fitted to an inside of the cup portion 21 while the side wall portion of the rotor holder 31 is pressed against a radially inner end portion (hereinafter referred to simply as a "top portion" as appropriate) of each of the first ribs 23, so that the rotor portion 3 is fixed to the impeller 2.

In this preferred embodiment, the cup portion 21 and the blades 22 of the impeller 2 are preferably integrally molded together in one piece of a resin, for example. Note, however, that they may be made of other materials than resin, e.g., metal or the like, in other preferred embodiments.

Figure 4:
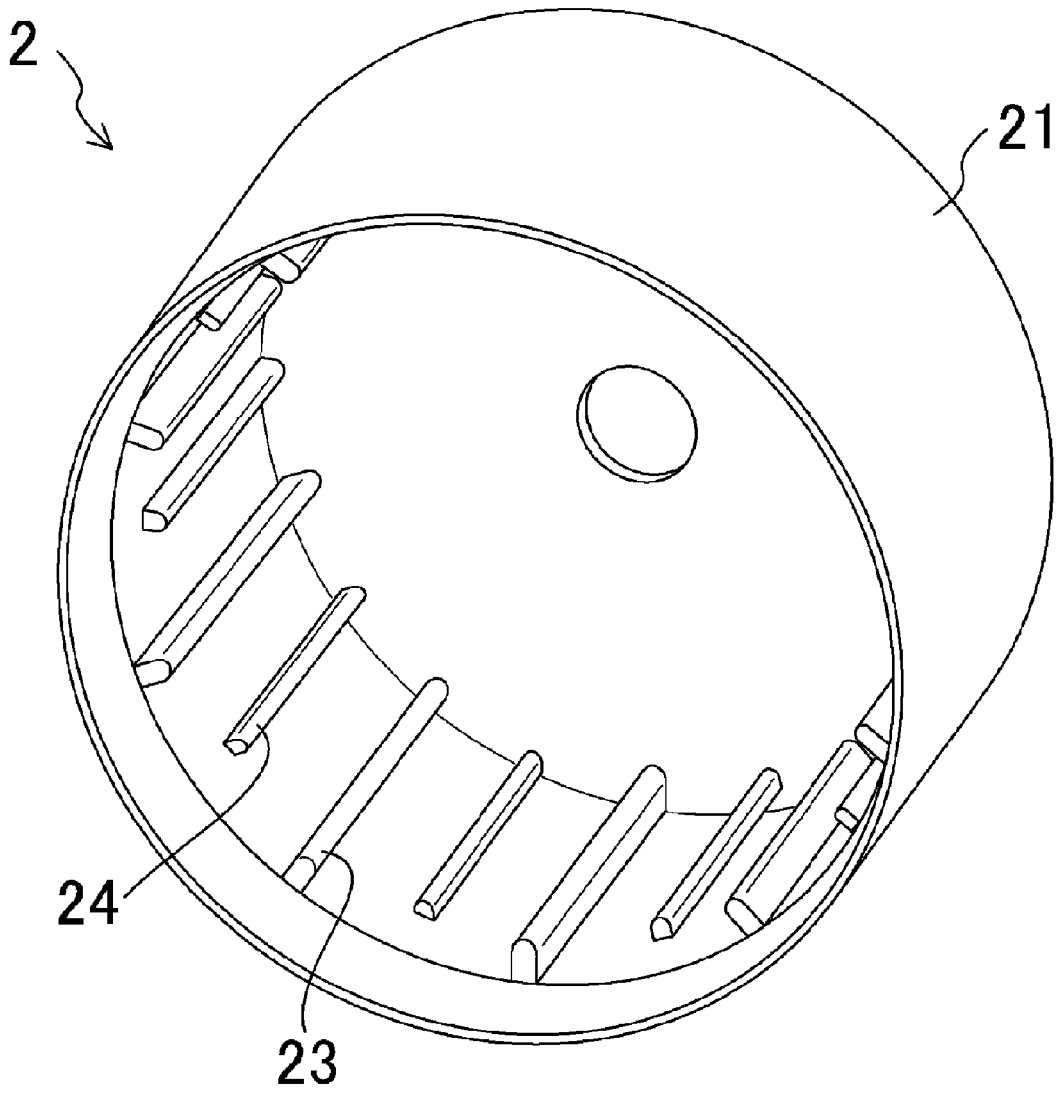
FIG. 4 is a perspective view illustrating the structure of a blower impeller according to a preferred embodiment of the present invention.
Figure 5:
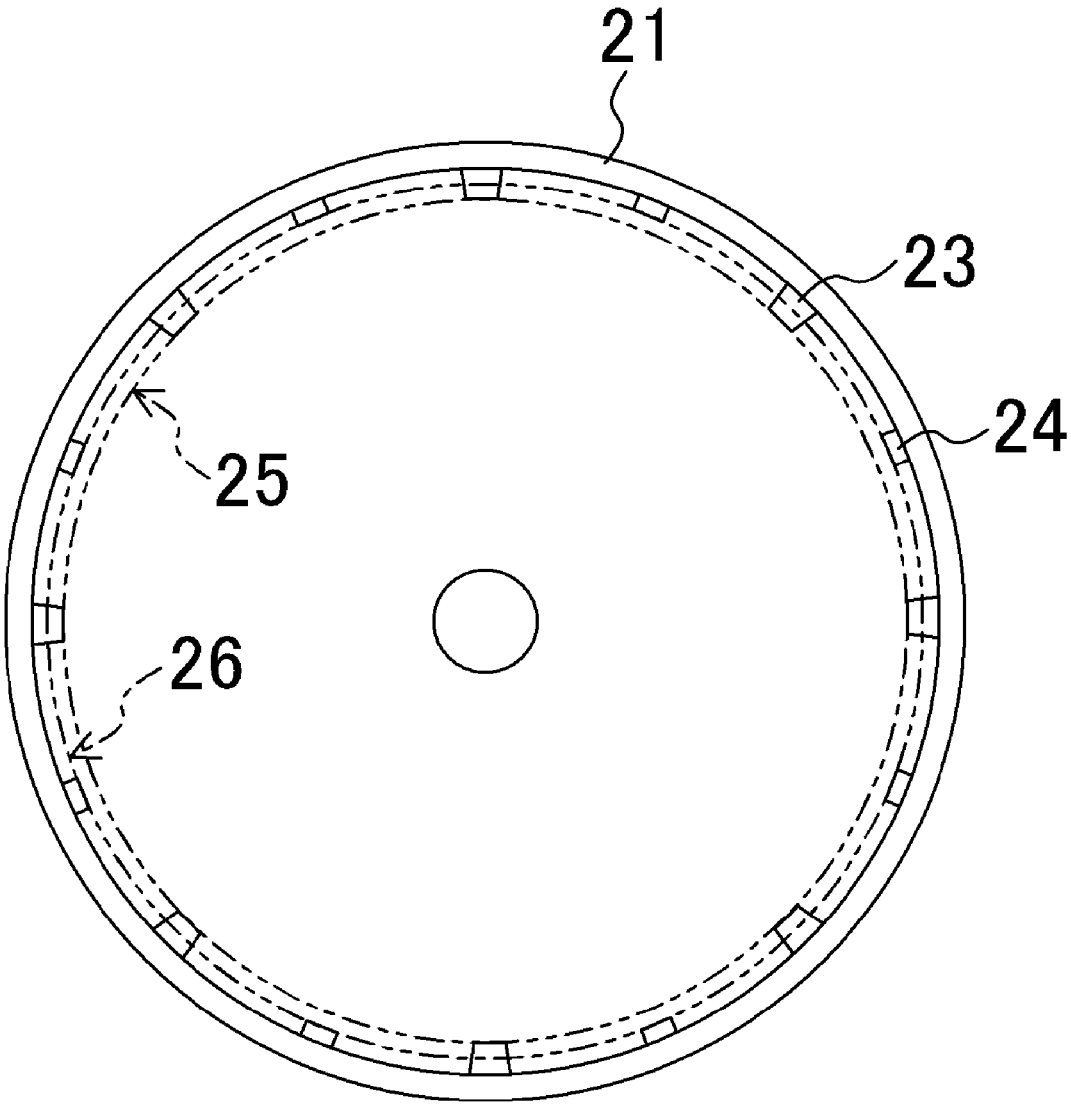
FIG. 5 is a bottom view illustrating the structure of the blower impeller according to a preferred embodiment of the present invention.

FIGS. 4 and 5 are diagrams illustrating the structure of the blower impeller 2 (the blades 22 are omitted in these figures) according to a preferred embodiment of the present invention. More specifically, FIG. 4 is a perspective view of the impeller 2 as viewed obliquely from below, and FIG. 5 is a bottom view of the impeller 2 as viewed from below in an axial direction.

As illustrated in FIG. 4, a plurality of axially extending first ribs 23 and a plurality of second ribs 24, each of which is preferably arranged between a separate pair of neighboring first ribs 23, are arranged in the circumferential direction on the inner circumferential surface of the circumferential wall portion of the cup portion 21. In addition, as illustrated in FIG. 5, the diameter of a virtual envelope 25 joining the radially innermost end portions of the first ribs 23 is smaller than the diameter of a virtual envelope 26 joining radially innermost end portions of the second ribs 24.

Figure 11:
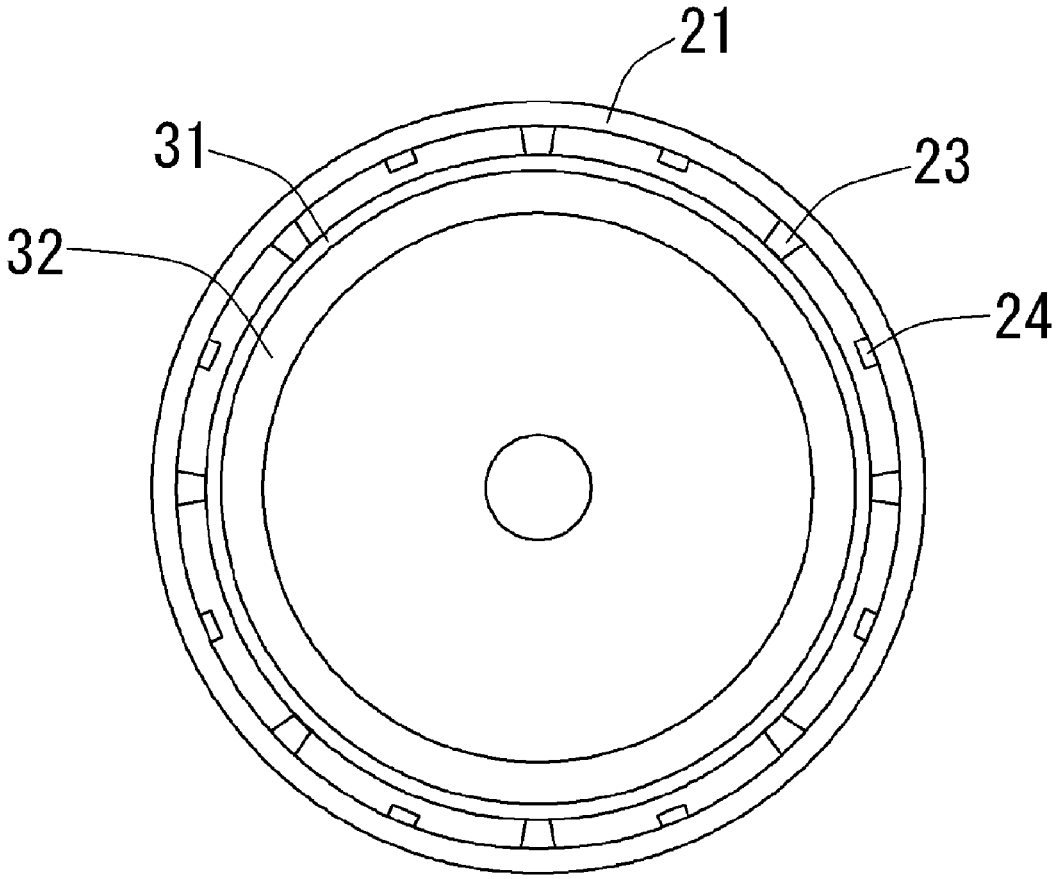
FIG. 11 is a bottom view illustrating the rotor holder after being fitted into a cup portion of the blower impeller according to a preferred embodiment of the present invention.

FIG. 11 illustrates the rotor holder 31 after being fitted into the cup portion 21 by, for example, press-fitting. As shown in FIG. 11, although the first ribs 23 and the second ribs 24 are arranged at a radially inner portion of the circumferential wall portion of the cup portion 21, only the first ribs 23, which are used in the fitting, contact the cup portion 21. This arrangement leaves a slight gap between the side wall portion of the rotor holder 31 and a radially inner end of the second ribs 24.

In the present preferred embodiment, the first ribs have a primary function of retaining the rotor holder 31 arranged inside the cup portion 21, whereas the second ribs 24 have a primary function of reinforcing the strength of the cup portion 21.

The diameter of the virtual envelope 25 joining the radially innermost end portions of the first ribs 23 is arranged to be smaller than the outer diameter of the side wall portion of the rotor holder 31. Thus, when the rotor holder 31 is press-fitted to the inside of the cup portion 21, the side wall portion of the rotor holder 31 is pressed against the top portion of each first rib 23. As a result, the rotor holder 31 is held securely by the cup portion 21. It is preferable that the first ribs 23 be arranged at regular intervals in the circumferential direction on the inner circumferential surface of the circumferential wall portion of the cup portion 21 so that the rotor holder 31 can be stably and securely held.

On the other hand, the diameter of the virtual envelope 26 joining the radially innermost end portions of the second ribs 24 is arranged to be greater than the outer diameter of the side wall portion of the rotor holder 31. Thus, the second ribs 24 do not provide resistance when the rotor holder 31 is press-fitted to the inside of the cup portion 21. Moreover, since each of the second ribs 24 is arranged between a separate pair of neighboring first ribs 23, uneven stresses applied by each of the blades 22 to an outer wall portion of the cup portion 21 are equalized. Thus, the strength of the cup portion is reinforced without having to increase the wall thickness of the cup portion 21.

Here, the first ribs 23 and the second ribs 24 can preferably be integrally molded with the cup portion 21 and the blades 22, for example. Therefore, it is easy to adjust the extent of the radially inward projection of each of the first ribs 23 and the second ribs 24 by varying the measurements of a mold.

In the present preferred embodiment, a requirement of a relationship between the first ribs 23 and the second ribs 24 can be defined by the relative lengths of the diameter of the virtual envelope joining the radially innermost end portions of the first ribs 23 and the diameter of the virtual envelope joining the radially innermost end portions of the second ribs 24. This requirement can also be described as follows: the extent of the radially inward projection of the first ribs 23 should be greater than the extent of the radially inward projection of the second ribs 24.

Note that, in the present preferred embodiment, the arrangements and the like of the first ribs 23 and the second ribs 24 are not limited in any particular manner as long as the aforementioned requirement is satisfied.

Figure 6A:
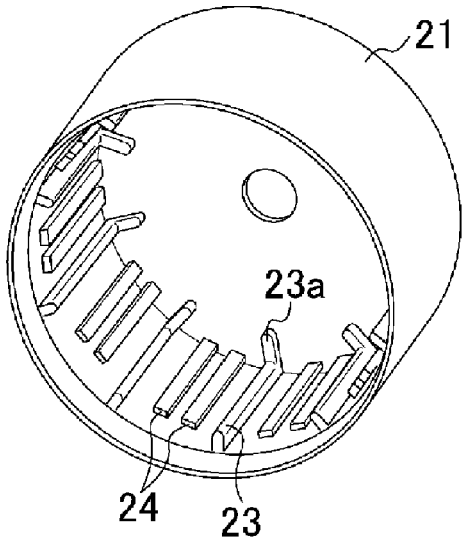
FIGS. 6A, 6B, 6C, and 6D are perspective views each illustrating the structure of a blower impeller according to preferred embodiments of the present invention.

FIGS. 6A, 6B, 6C, and 6D are each a perspective view illustrating an exemplary arrangement of the second ribs 24 according to various preferred embodiments of the present invention. FIG. 6A illustrates an exemplary case where a plurality of second ribs 24 (two second ribs 24 in this particular example of FIG. 6A) are arranged between each pair of neighboring first ribs 23. As described above, the second ribs 24 do not provide resistance when the rotor holder 31 is press-fitted to the inside of the cup portion 21. Therefore, in the case where each pair of neighboring first ribs 23 has a large space therebetween, a plurality of second ribs 24 may be arranged between each pair of neighboring first ribs 23, so that the uneven stresses applied by each of the blades 22 to the outer wall portion of the cup portion 21 can be more equalized.

Figure 6B:
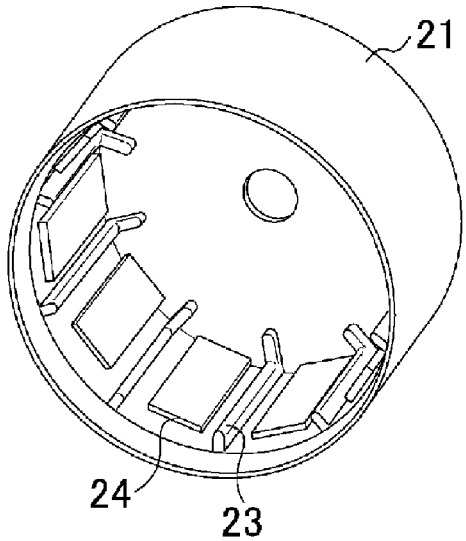

FIG. 6B illustrates an exemplary case where a second rib 24 having a greater width than that of the first ribs 23 is arranged between each pair of neighboring first ribs 23. This arrangement produces essentially the same effect as would be produced by increasing the wall thickness of the cup portion 21, resulting in a further improvement in the strength of the cup portion 21.

Figure 6C:
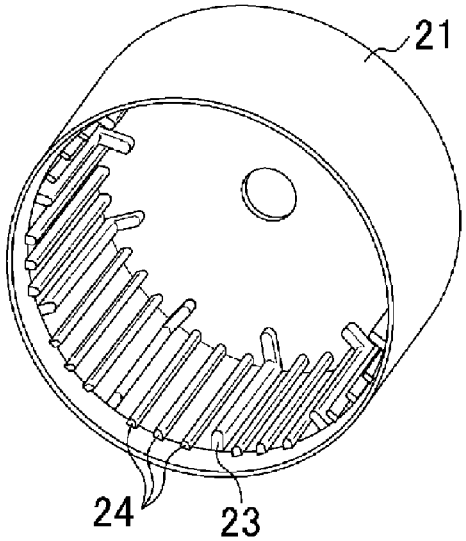

FIG. 6C illustrates an exemplary case where second ribs 24 having a greater axial length than that of the first ribs 23 are arranged between each pair of neighboring first ribs 23. The stresses applied by each of the blades 22 to the outer wall portion of the cup portion 21 have an uneven distribution in the axial direction with respect to the cup portion 21 as well. It is possible to equalize, to a greater extent, the axially uneven stresses applied to the outer wall portion of the cup portion 21, by increasing the axial length of the second ribs 24.

Figure 6D:
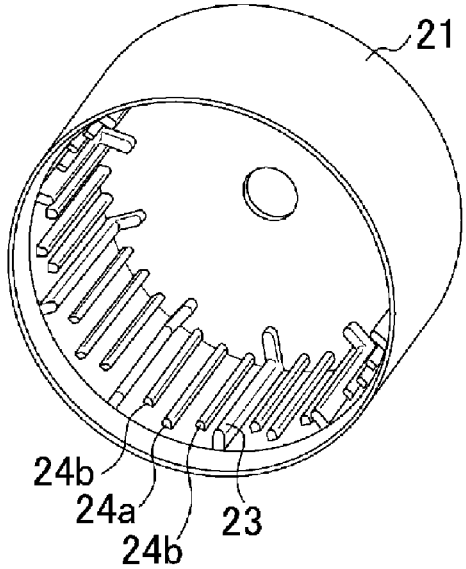

FIG. 6D illustrates an exemplary case where two types of second ribs 24*a* and 24*b* with different axial lengths are arranged between each pair of neighboring first ribs 23. In the illustrated example, the second ribs 24*a* have a greater axial length than that of the second ribs 24*b*. The distribution of the stresses applied to the outer wall portion of the cup portion 21 varies depending on the number, shape, and the like of the blades 22 arranged on the outer circumferential surface of the circumferential wall portion of the cup portion 21. Thus, optimum equalization of the uneven stresses can be achieved by combined arrangement of two or more types of second ribs 24 with different lengths in accordance with the number, shape, and the like of the blades 22. Note that the two or more types of second ribs 24 may differ not only in the axial length but also in circumferential width or the extent of the radially inward projection. In this case, the virtual envelope 26 joining the radially inner end portions of the second ribs 24 is defined separately for each type of the second ribs 24.

Here, as illustrated in FIG. 6A, a pedestal 23*a* protruding radially inward may be provided at an end portion of each first rib 23 on a side closer to the cover of the cup portion 21. In this case, when the rotor holder 31 has been press-fitted to the inside of the cup portion 21, an annular plate portion of the rotor holder 31, which protrudes radially inward from an upper end portion of the side wall portion of the rotor holder 31, comes into contact with the pedestals 23*a*. Therefore, application of an adhesive 241 to a gap between the pedestals 23*a* and the annular plate portion of the rotor holder 31 will further improve retention between the cup portion 21 and the rotor holder 31.

In the blower impeller 2 according to the present preferred embodiment, in addition to the first ribs 23 arranged to retain the rotor holder 31, the second ribs 24 are arranged on the inner circumferential surface of the circumferential wall portion of the cup portion 21 such that the second ribs 24 have a primary function of reinforcing the strength of the cup portion 21. The second ribs 24 differ from the first ribs 23 in the extent of the radially inward projection. Thus, the additional provision of the second ribs 24, with a different extent of the radially inward projection from that of the first ribs 23, may cause a displacement of the center of gravity of the impeller 2.

Furthermore, the second ribs 24 may differ from the first ribs 23, not only in the extent of the radially inward projection, but also in the circumferential width or the axial length.

In the impeller 2 according to the present preferred embodiment, the first ribs 23, the second ribs 24, the cup portion 21, and the blades 22 can be formed integrally by injection molding, for example. Thus, various balance adjustments of adjusting the displacement of the center of gravity of the impeller 2 can be performed. For example, a balance adjustment at the upper end portion (i.e., the end portion at the cover of the cup portion 21) of the cup portion can be accomplished by providing the pedestals 23*a* at the upper end portions of the first ribs 23 (i.e., the end portions thereof on the side closer to the cover of the cup portion 21) as illustrated in FIG. 6A, for example. The provision of the pedestals 23*a* can be easily accomplished by adjusting the mold used in the forming of the cup portion 21 through, for example, injection molding.

However, the first ribs 23 lack such dimensional latitude as to allow adjustment of the axial length thereof, because the first ribs 23 need to maintain their primary function of retaining the rotor holder 31. Therefore, it is more difficult to adjust the axial length of the first ribs 23 to accomplish a balance adjustment at a lower end portion (i.e., an end portion closer to an opening of the cup portion 21) of the cup portion 21 than it is to adjust the axial length of the second ribs 24.

In contrast, the second ribs 24 have sufficient dimensional latitude to allow adjustment of the axial length thereof, because the second ribs 24 perform the primary function of reinforcing the strength of the cup portion 21. Therefore, the balance adjustment at the lower end portion of the cup portion 21 can be accomplished by adjusting the axial length of the second ribs 24 without adversely affecting the primary function of reinforcing the strength of the cup portion 21. In other words, portions that define the lower end portions of the second ribs 24 can be employed to accomplish a balance adjustment function of adjusting the displacement of the center of gravity of the impeller 2.

Figure 7:
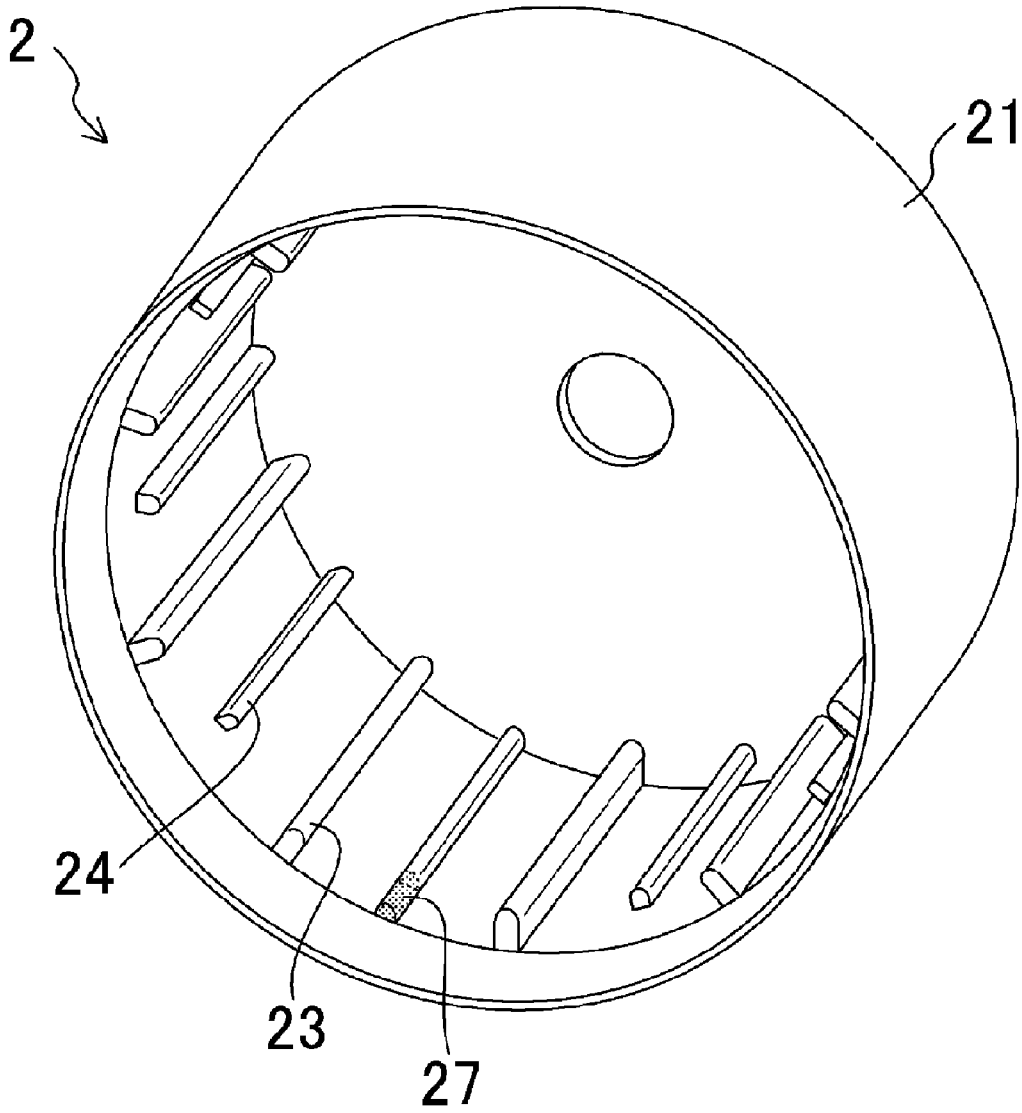
FIG. 7 is a perspective view illustrating the structure of a blower impeller on which a balance adjustment according to a preferred embodiment of the present invention has been performed.

FIG. 7 is a perspective view illustrating the structure of the impeller 2 as illustrated in FIG. 4 in which a balance adjustment has been performed on the cup portion 21 of the impeller 2. As illustrated in FIG. 7, a lower end portion 27 of one of the second ribs 24 which has been modified for balance adjustment extends farther toward the lower end (on the opening side) of the cup portion 21 than the lower end portions of the other (non-adjusted) second ribs 24. Note that balance adjustment could also be easily accomplished by removing a portion of the mold which corresponds to the lower end portion 27 of the balance-adjusted second rib 24, rather than by adding a portion as is shown in the present preferred embodiment of the present invention in FIG. 7.

Figure 8:
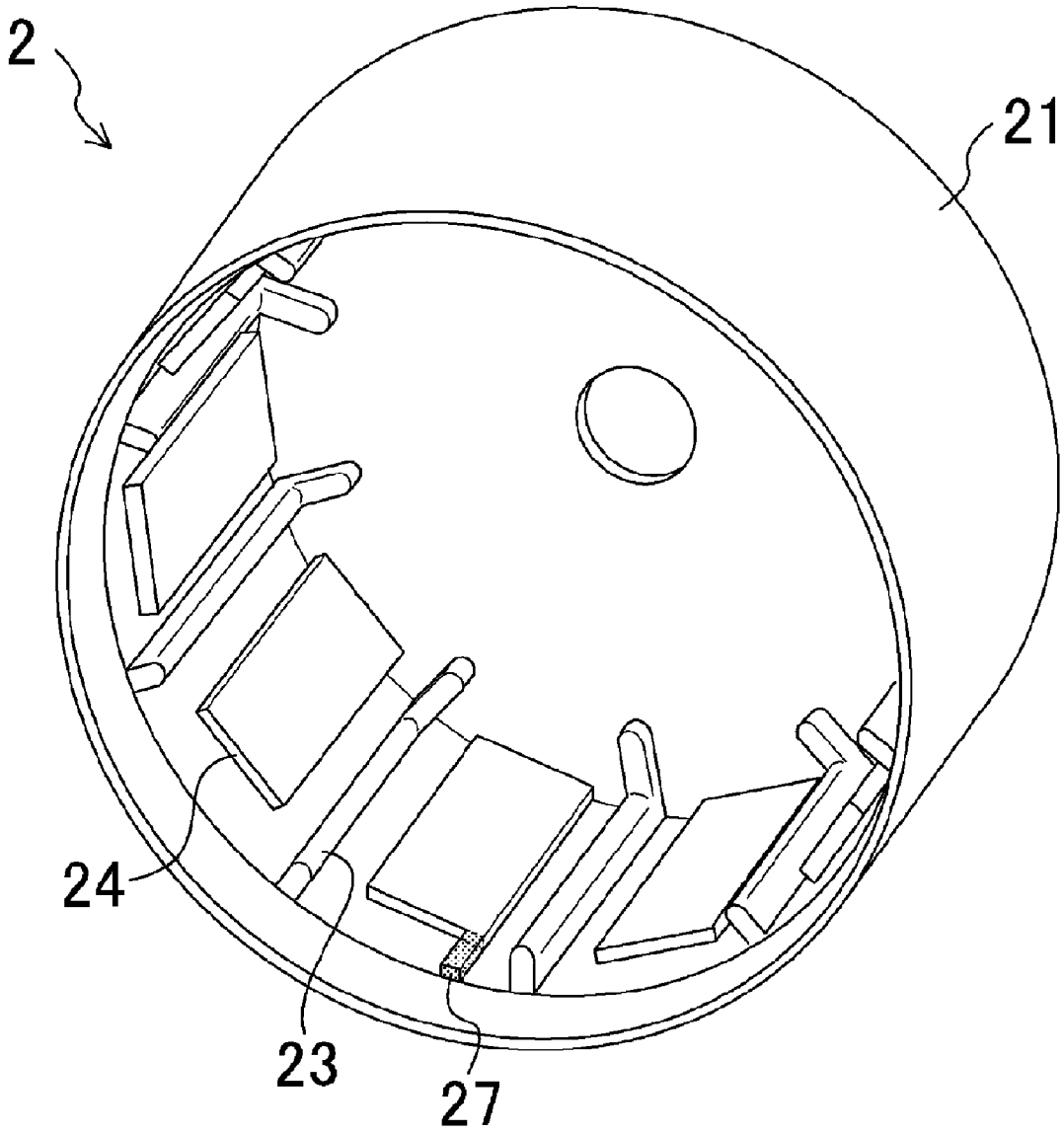
FIG. 8 is a perspective view illustrating the structure of a blower impeller on which a balance adjustment according to a preferred embodiment of the present invention has been performed.

Referring to FIG. 8, in the case where the second ribs 24 are arranged to have a greater width than that of the first ribs 23 as illustrated in FIG. 6B, a portion 27 of the lower end portion of any of the second ribs 24 may be arranged to project toward the lower end (on the opening side) of the cup portion 21 to accomplish the balance adjustment. In the case where a plurality of second ribs 24 are arranged between each pair of neighboring first ribs 23 as illustrated in FIG. 6C, a balance adjustment in the circumferential direction with respect to the cup portion 21 can be accomplished easily by adjusting the axial length of two or more of the second ribs 24.

Here, as illustrated in FIGS. 7 and 8, the balance-adjusted second rib 24 can be identified by the portion 27 thereof which projects toward the lower end of the cup portion 21. The cup portion 21 on which the balance adjustment has been performed can be defined as follows.

Figure 9:
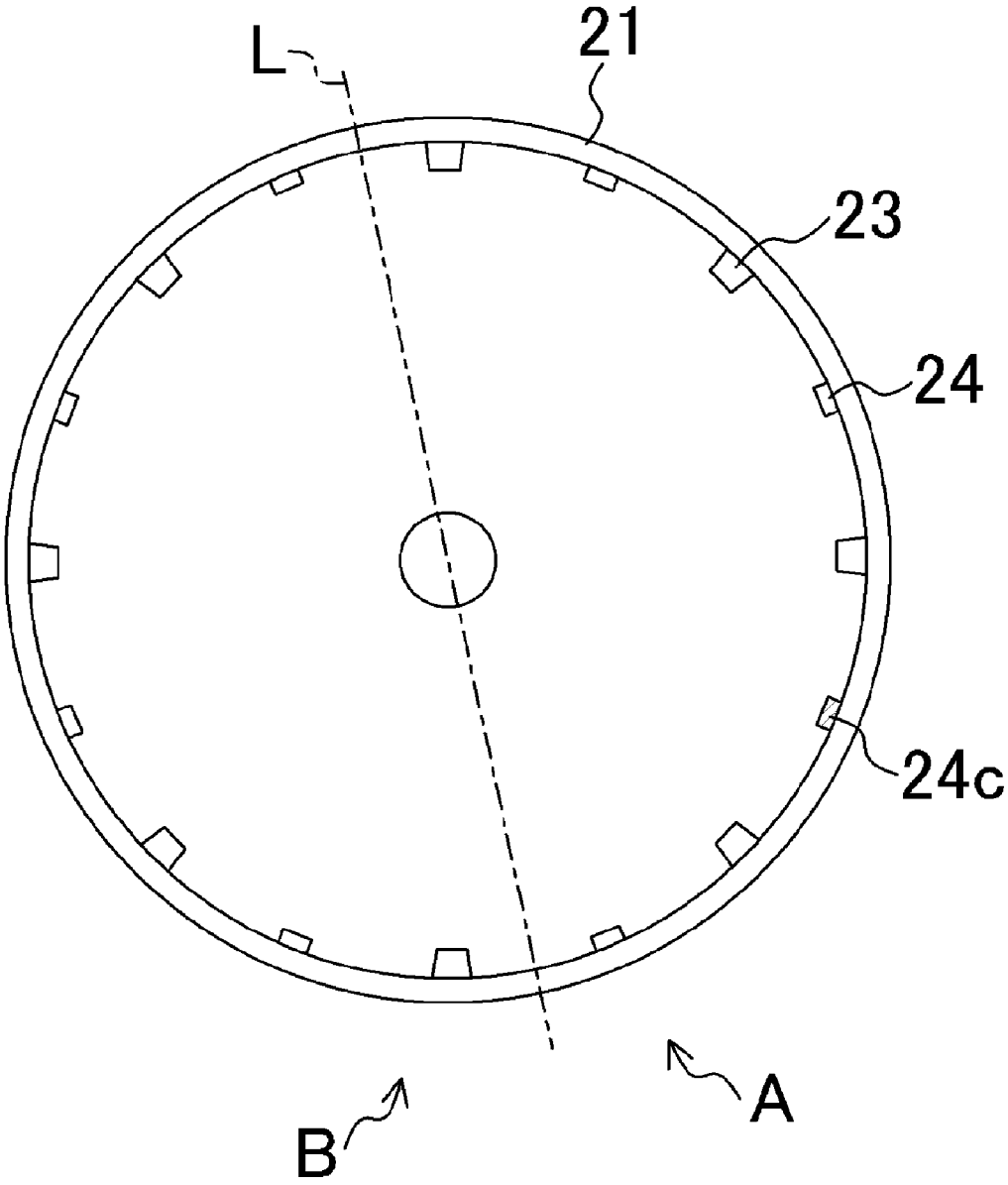
FIG. 9 is a bottom view illustrating the structure of a blower impeller on which a balance adjustment according to a preferred embodiment of the present invention has been performed.

That is, referring to FIG. 9, when the substantially cylindrical cup portion 21 is divided into two semi-cylinders A and B by an arbitrary imaginary plane L including the central axis of the cup portion 21, the total volume of the second ribs arranged on an inner circumferential surface of a circumferential wall portion of the semicylinder A is different from the total volume of the second ribs 24 arranged on an inner circumferential surface of a circumferential wall portion of the semicylinder B.

Another definition is possible as follows. That is, in the case where the balance adjustment has been performed on one or more of the second ribs 24, when the cup portion 21 is circumferentially divided into two equal portions, a semicylinder A including the one or more balance-adjusted second ribs 24*c*, which is different from others of the second ribs 24 as a result of adding or removing of material, and a semicylinder B not including any balance-adjusted second rib 24, the total volume of the second ribs 24 included in the semicylinder A is greater than or less than the total volume of the second ribs 24 included in the semicylinder B depending on whether material has been added to or removed from the one or more balance-adjusted second ribs 24*c*.

Figure 10:
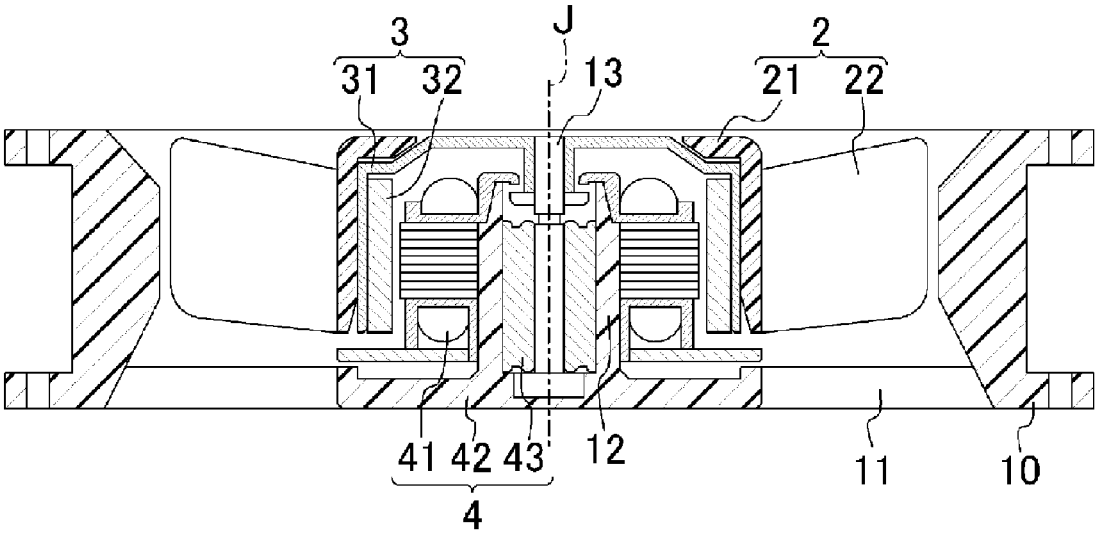
FIG. 10 is a cross-sectional view illustrating the structure of a blower according to another preferred embodiment of the present invention.

While the present invention has been described above with reference to preferred embodiments, the foregoing description is not to be construed as restrictive, but various modifications are possible. For example, although the cup portion 21 of the impeller 2 is substantially defined by a covered cylinder in the above-described preferred embodiments, the cup portion 21 may be substantially in the shape of a cylinder without a cover as illustrated in FIG. 10 in other preferred embodiments. In this case, the rotor holder 31 is substantially in the shape of a covered cylinder, the shaft 13 is fixed at a central portion of a cover of the rotor holder 31, and the shaft 13 is inserted inside the sleeve 43 so as to be rotatably supported by the sleeve 43.

Also, although an outer-rotor motor is preferably used as a motor of the blower according to the above-described preferred embodiment, an inner-rotor motor may be used in other preferred embodiments. Also, although the oil-impregnated bearing including the sleeve 43 is used as the bearing mechanism of the motor in the above-described preferred embodiments of the present invention, a bearing mechanism of a ball bearing type, or any other desired bearing type, may be used in other preferred embodiments of the present invention, for example.

Figure 12:
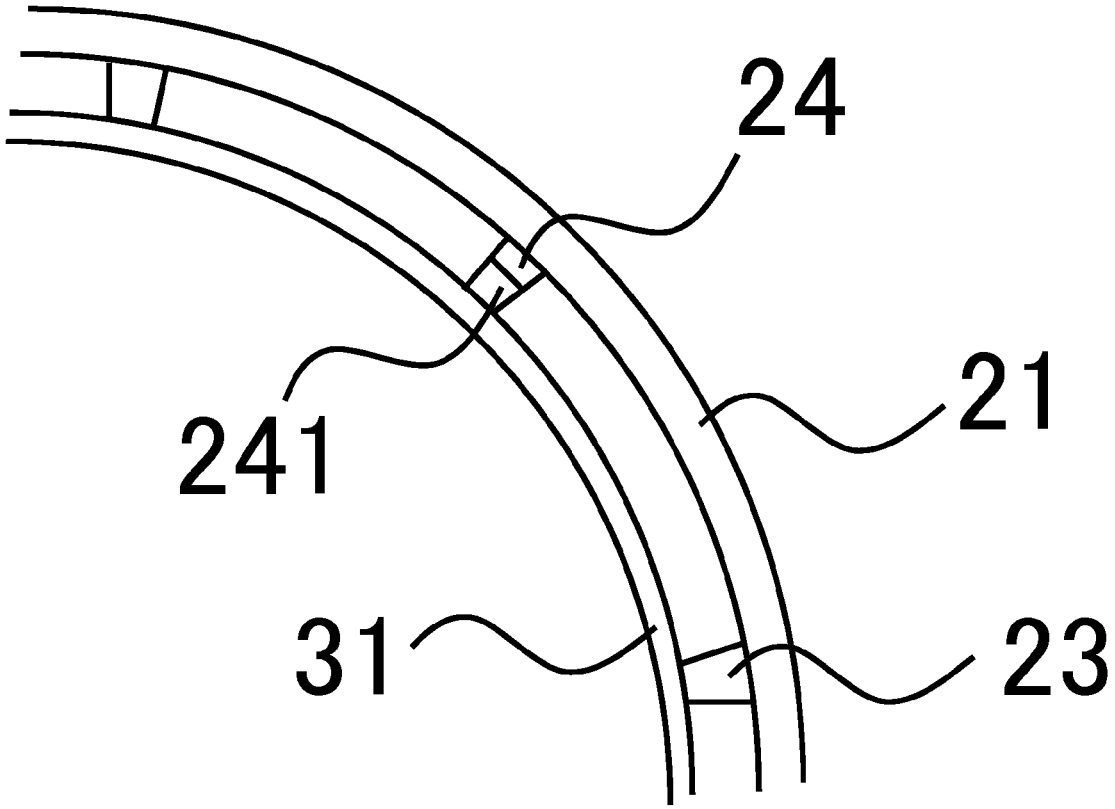
FIG. 12 is a bottom view illustrating the structure of a blower impeller according to a preferred embodiment of the present invention.

Also, since there is a slight gap between the side wall portion of the rotor holder 31 and the radially inner end portion of each second rib 24, an adhesive 241 may be applied to this gap to further improve the retention between the cup portion 21 and the rotor holder 31, as shown, for example, in FIG. 12.

Only selected preferred embodiments have been chosen to illustrate the present invention. To those skilled in the art, however, it will be apparent from the foregoing disclosure that various changes and modifications can be made herein without departing from the scope of the invention as defined in the appended claims. Furthermore, the foregoing description of the preferred embodiments according to the present invention is provided for illustration only, and not for limiting the invention as defined by the appended claims and their equivalents.

What is claimed is:

1. A blower impeller comprising:

a substantially cylindrical cup portion; and a plurality of blades arranged on an outer circumferential surface of a circumferential wall portion of the cup portion; wherein the cup portion includes a plurality of axially extending first ribs and a plurality of second ribs arranged between the first ribs on an inner circumferential surface of the circumferential wall portion thereof, the plurality of axially extending first ribs and the plurality of second ribs being arranged in a circumferential direction of the cup portion, the plurality of axially extending first ribs extending farther in the axial direction than the plurality of second ribs; and a virtual envelope joining radially innermost end portions of the plurality of axially extending first ribs has a smaller diameter than that of a virtual envelope joining radially innermost end portions of the plurality of second ribs.

2. A blower impeller comprising:

a substantially cylindrical cup portion; and a plurality of blades arranged on an outer circumferential surface of a circumferential wall portion of the cup portion; wherein the cup portion includes a plurality of axially extending first ribs and a plurality of second ribs arranged between the first ribs provided on an inner circumferential surface of the circumferential wall portion thereof, the plurality of axially extending first ribs and the plurality of second ribs being arranged in a circumferential direction, the plurality of axially extending first ribs extending farther in the axial direction than the plurality of second ribs; and an extent of radially inward projection of the plurality of axially extending first ribs is greater than an extent of radially inward projection of the plurality of second ribs.

3. The blower impeller according to claim 1, wherein the plurality of axially extending first ribs are arranged at regular intervals in the circumferential direction on the inner circumferential surface of the circumferential wall portion of the cup portion.

4. The blower impeller according to claim 1, wherein at least two of the plurality of second ribs are arranged between each adjacent pair of the plurality of axially extending first ribs.

5. The blower impeller according to claim 1, wherein the plurality of second ribs have a greater circumferential width than that of the plurality of axially extending first ribs.

6. The blower impeller according to claim 1, wherein the plurality of axially extending first ribs are arranged to retain a rotor holder arranged inside the cup portion, and the plurality of second ribs are arranged to reinforce a strength of the cup portion.

7. The blower impeller according to claim 6, wherein lower end portions of the plurality of second ribs include shapes that are arranged to adjust a displacement of a center of gravity of the impeller.

8. The blower impeller according to claim 7, wherein a lower end portion of any of the plurality of second ribs which include shapes that are arranged to adjust a displacement of a center of gravity of the impeller extends farther toward a lower end of the cup portion than the lower end portion of any of the plurality of second ribs which do not include shapes that are arranged to adjust the displacement of the center of gravity of the impeller.

9. The blower impeller according to claim 7, wherein when the substantially cylindrical cup portion is divided into first and second semicylinders by an arbitrary imaginary plane including a central axis of the cup portion, a total volume of the plurality of second ribs arranged on an inner circumferential surface of a circumferential wall portion of the first semicylinder is different from a total volume of the plurality of second ribs arranged on an inner circumferential surface of a circumferential wall portion of the second semicylinder.

10. The blower impeller according to claim 7, wherein at least one of the plurality of second ribs is different from others of the plurality of second ribs such that a balance of the cup portion is adjusted; and when the cup portion is circumferentially divided into two equal portions, the two equal portions including a first semicylinder including the at least one balance-adjusted rib of the plurality of second ribs and a second semicylinder not including any of the at least one balance-adjusted rib of the plurality of second ribs, a total volume of the plurality of second ribs included in the first semicylinder is greater than a total volume of the plurality of second ribs included in the second semicylinder.

11. The blower impeller according to claim 7, wherein the impeller is made of a molded material; and the lower end portion of any of the plurality of second ribs on which a balance adjustment has been performed corresponds to a removed portion of the molded impeller.

12. The blower impeller according to claim 1, wherein a number of the plurality of blades is five or less.

13. A blower comprising:

the blower impeller of claim 1; and a rotor holder including a side wall portion and arranged to rotate integrally with the impeller; wherein the rotor holder is press-fitted to an inside of the cup portion while being pressed against the radially inner end portions of the plurality of axially extending first ribs, so that the rotor holder is retained by the impeller; and an outer diameter of the side wall portion of the rotor holder is smaller than the diameter of the virtual envelope joining the radially innermost end portions of the plurality of second ribs.

14. The blower according to claim 13, further comprising an adhesive provided in a gap between the side wall portion of the rotor holder and the radially innermost end portions of the plurality of second ribs.

15. The blower impeller according to claim 2, wherein the plurality of axially extending first ribs are arranged to retain a rotor holder arranged inside the cup portion, and the plurality of second ribs are arranged to reinforce a strength of the cup portion.

16. The blower impeller according to claim 15, wherein lower end portions of the plurality of second ribs include shapes that are arranged to adjust a displacement of a center of gravity of the impeller.

17. The blower impeller according to claim 16, wherein a lower end portion of any of the plurality of second ribs which include shapes that are arranged to adjust a displacement of a center of gravity of the impeller extends farther toward a lower end of the cup portion than the lower end portion of any of the plurality of second ribs which do not include shapes that are arranged to adjust the displacement of the center of gravity of the impeller.

18. The blower impeller according to claim 16, wherein when the substantially cylindrical cup portion is divided into first and second semicylinders by an arbitrary imaginary plane including a central axis of the cup portion, a total volume of the plurality of second ribs arranged on an inner circumferential surface of a circumferential wall portion of the first semicylinder is different from a total volume of the plurality of second ribs arranged on an inner circumferential surface of a circumferential wall portion of the second semicylinder.

19. The blower impeller according to claim 16, wherein at least one of the plurality of second ribs is different from others of the plurality of second ribs such that a balance of the cup portion is adjusted; and when the cup portion is circumferentially divided into two equal portions, the two equal portions including a first semicylinder including the at least one balance-adjusted rib of the plurality of second ribs and a second semicylinder not including any of the at least one balance-adjusted rib of the plurality of second ribs, a total volume of the plurality of second ribs included in the first semicylinder is greater than a total volume of the plurality of second ribs included in the second semicylinder.

* * * * *